United States Patent [19]

Leonard et al.

[11] Patent Number: 4,984,365

[45] Date of Patent: Jan. 15, 1991

[54] SAFETY RAZOR

[75] Inventors: Elizabeth C. Leonard, Cambridge; Jill M. Shurtleff, South Boston, both of Mass.

[73] Assignee: The Gillette Company, Boston, Mass.

[21] Appl. No.: 519,053

[22] Filed: May 4, 1990

[51] Int. Cl.[5] ..... B26B 19/38

[52] U.S. Cl. ..... 30/34.05; 30/49; 30/90

[58] Field of Search ..... 30/32, 34.05, 41, 49, 30/90, 47, 48, 84

[56] References Cited

U.S. PATENT DOCUMENTS

| | | | |
|---|---|---|---|
| 2,354,657 | 8/1944 | Arey | 30/43 |
| 2,614,321 | 10/1952 | Ackerman | 30/34 |
| 2,989,804 | 7/1961 | Yellon | 30/32 |
| 3,702,026 | 11/1972 | Scholin | 30/49 |
| 4,459,744 | 7/1984 | Esnard | 30/49 |
| 4,483,068 | 11/1984 | Clifford | 30/49 |
| 4,807,360 | 2/1989 | Cerier et al. | 30/49 |
| 4,944,090 | 7/1990 | Sumnall | 30/41 |

*Primary Examiner*—Douglas D. Watts
*Attorney, Agent, or Firm*—Fish & Richardson

[57] ABSTRACT

A safety razor has a thin flexible metal foil member with a plurality of apertures, and an edge of each aperture is sharpened to define a shaving edge. The foil member is disposed on support surface structure and thin, flexible protective sheet structure with a skin-engaging surface extends about the perimeter of the metal foil member and is secured in overlying relation to the support surface and to the foil member with the apertures of the foil member exposed in shaving relation immediately adjacent and surrounded by the skin engaging surface of the protective sheet structure.

20 Claims, 2 Drawing Sheets

SAFETY RAZOR

This invention relates to safety razors, and more particularly to a razor that employs a razor blade in the form of a metal foil in which an array of apertures are formed, the periphery of each aperture being sharpened to provide a cutting edge.

In accordance with the invention, there is provided a razor with a body member having a through aperture therein and support surface structure around the aperture. A thin flexible metal foil member with a plurality of foil apertures is provided. The edge of each foil aperture is sharpened to define a shaving edge. The foil member is disposed on the support surface structure of the body member to overlie the through aperture in supporting relation. A skin-engaging protective sheet structure has an outer perimeter greater than the outer perimeter of the metal foil blade member and an inner perimeter smaller than the outer perimeter of the metal foil blade member and is adhesively secured (bonded) in overlying relation on the foil member and the support surface structure so that the protective sheet structure overlies and encases the thin and often sharp outer edge of the foil member and the apertures of the foil member are exposed in shaving relation immediately adjacent and surrounded by the skin engaging surface of the protective sheet structure. The protective sheet structure holds the foil member in place so that the foil member is not displaced relative to the support surface structure of the body member as the razor is moved across the skin in shaving action.

The thickness of the protective sheet structure is preferably about half that of the foil member. In a particular embodiment, the thickness of the flexible foil member is about 0.1 millimeter and the thickness of the protective sheet is about 0.05 millimeter. In particular embodiments, the periphery of the foil member is disposed in a recess in the support surface. Easy, inexpensive and reliable securing of the foil shaving member to the body member is provided in a razor which can be manufactured using, for example, commercially available labeling equipment.

In particular embodiments, the protective sheet may include a low friction outer surface or a shave-facilitating coating on the outer surface or both. While a variety of protective sheet materials may be used, in preferred embodiments, the protective sheet structure includes a sheet member of high tear resistant polymer material that has appropriate properties such as impermeability to water, low friction and wear resistance. Preferably, the protective sheet structure includes a base film selected from, for example, cellulose acetate, cellophane, vinyl, Tetrafluoroethylene (TFE) and polyester, and a water resistant, pressure sensitive contact adhesive that bonds to both the metal foil and the support surface which preferably is of polymeric material. Preferred adhesives include an inherently pressure sensitive polymer, and a blend of elastomers with tackifying resins, plasticizer and the like. In particular embodiments, the razor cap support surface is of convex configuration and the metal foil blade member is flexed into bowed configuration that conforms to the convex configuration of the razor cap support surface. The support surface may include a recess for receiving the foil and, in a particular embodiment, the depth of the recess and the thickness of the foil are substantially the same, for example, about 0.1 millimeter. In preferred embodiments, the metal foil blade member has at least ten shaving edge defining apertures of circular configuration.

Other features and advantages will be seen as the following description of particular embodiments progresses, in conjunction with the drawings, in which.

Figure 3:
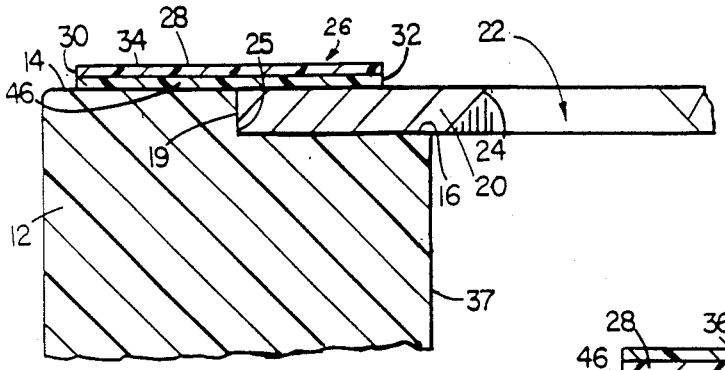
FIG. 3 is a diagrammatic cross sectional view taken along the line 3—3 in FIG. 2.
Figure 3A:
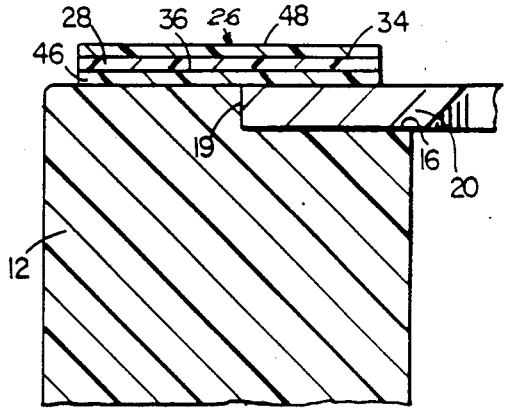

FIG. 3*a* is a diagrammatic cross sectional view of another embodiment; and

Figure 1:
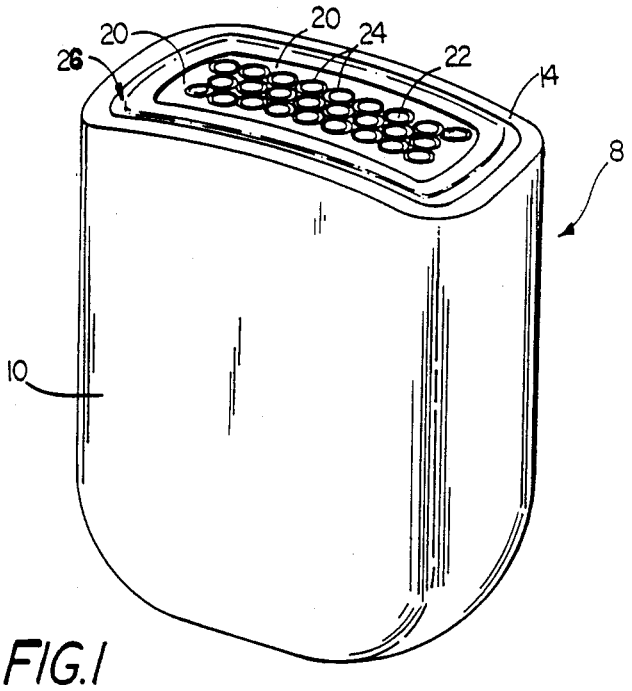
FIG. 1 is a perspective view of a razor in accordance with the invention.
Figure 2:
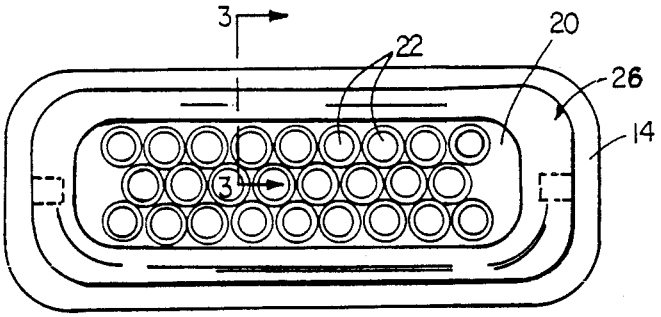
FIG. 2 is a plan view of the razor of FIG. 1.
Figure 4:
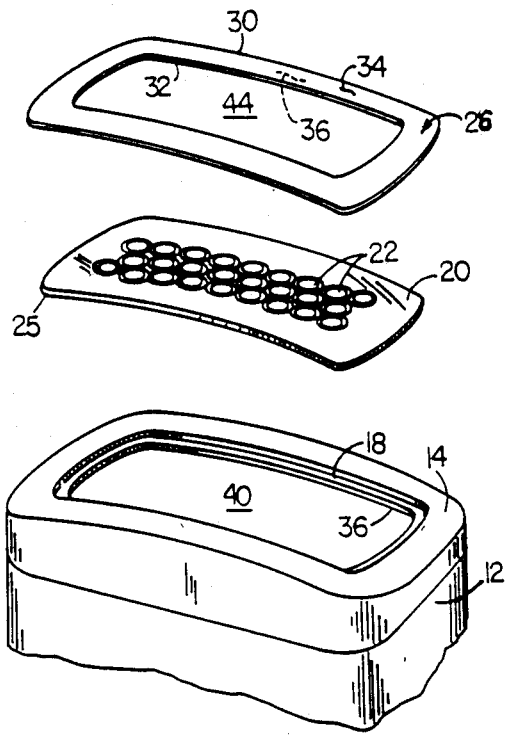

FIG. 4 is an exploded assembly view of the razor of FIG. 1;

DESCRIPTION OF PARTICULAR EMBODIMENTS

The razor 8 shown in FIGS. 1–4 includes molded body 10 and molded cap portion 12 that has convex top surface 14 in which annular recess 18 is formed that has a depth of about 0.1 millimeter and a width of about two millimeters. The inner periphery 17 of recess 18 defines an aperture 40 in the top surface 14 of cap portion 12. Seated on recess 18 and positioned over aperture 40 is a multi-apertured metal foil 20 that has apertures 22, the edges 24 of which are sharpened shaving edges. Foil 20 is about 4.2 centimeters long, about 2.2 centimeters wide and about 0.1 millimeter thick. The peripheral edge 25 of foil 20 seats snugly against the back 19 of recess 18. Protective sheet structure 28 has adhesive layer 46 and secures foil 20 to surface 14. Sheet structure 28 has an outer periphery 30 about 4.8 centimeters in length and 1.8centimeters in width and an inner margin 32 (defining an opening 44 in the sheet) that is about four centimeters in length and about one centimeter in width. Sheet structure 28 overlies foil 20 such that the margin of the foil 20 and the adjacent surface 14 are protectively overlaid by sheet 28, and a smooth skin-engaging surface with little height differential between foil 20 and sheet structure 28 is provided.

The metal foil blade 20 is manufactured of 0.1 millimeter thick strip steel and has an array of circular apertures 22 disposed in rows that are spaced about three millimeters on center. Each aperture 22 has a diameter of about two millimeters. Body 10 and cap 12 are molded of polypropylene and cap 12 has a convex upper surface 14 (of about 12.5 centimeters radius).

Referring now to FIGS. 3 and 3*a*, protective sheet structure 28 includes sheet member 26 with adhesive layer 46 on lower surface 36 and, optionally, coating 48 on opposite upper surface 34. Coating 48 may include a suitable shave-facilitating agent such as a moisturizer or a lubricant which reduces friction during shaving. Sheet member 26 is a polymeric film with desirable properties such as impermeability and thinness. Suitable film materials include cellulose acetate, cellophane, plasticized vinyl tapes, polytetrafluoroethylene (PTFE) and polyester. Polyester films are known, for example, for their high tensile strength and tear properties. PTFE acts as a dry lubricant and provides a non-stick surface. Polyethylene provides low water vapor transmission. The film 26 may be colored, etched or otherwise decorated, for example, with a company logo, and have a glossy or smooth surface.

Adhesive 46 is preferably pressure sensitive and resistant to water and soap solutions and has properties such as high tack, resistance to peel and creep, as well as high resistance to mechanical forces (e.g., movement of the razor across the skin), good bond strength and reasonable resistance to aging and weathering (e.g., modest heat, exposure to UV light). The adhesive may be a blend of elastomers with tackifying resins, plasticizer and the like, or an inherently pressure sensitive polymer, such as a polyacrylate, which requires no compounding. Common elastomers include natural rubber, styrene-butadiene copolymers, and silicones. Various resins and tackifiers are known, for example, polyterpene resins. Formulation and curing can be optimized to produce desired properties.

In a particular embodiment, the film member 26 is about 0.05 millimeter thick and the adhesive 46 is about 0.02 millimeter thick so that the total thickness (film material plus adhesive in the compressed state) is about 0.07 millimeter. The sheet structure has a high gloss, low friction outer surface. The optional shave facilitating agent 48 may include polyethylene oxide.

The body portion 10 and cap portion 12 are preferably injection molded parts with smooth rounded edges. In assembly of the razor, foil 20 is seated in recess 18 in flexed, bowed shape; and protective sheet structure 28 is applied with label applying equipment to firmly and positively secure foil member 20 on cap 12.

While particular embodiments of the invention has been shown and described, various modifications will be apparent to those skilled in the art, and therefore it is not intended that the invention be limited to the disclosed embodiments or to details thereof, and departures may be made therefrom within the spirit and scope of the invention.

What is claimed is:

1. A safety razor comprising a body member having a through aperture therein and support surface structure around said aperture, a thin flexible metal foil member with a plurality of apertures therein, the edge of each said aperture being sharpened to define a shaving edge, said foil member being disposed on said support surface structure of said body member to overlie said aperture in supporting relation, and protective sheet structure that has a skin-engaging surface, an outer perimeter greater than the outer perimeter of said metal foil blade member and an inner perimeter smaller than the outer perimeter of said metal foil blade member, said protective sheet structure being secured in overlying relation on both said support surface structure and said foil member so that the apertures of said foil member are exposed in shaving relation immediately adjacent and surrounded by said skin-engaging surface of said protective sheet structure, and said foil member remains firmly secured relative to said support surface structure as the razor is moved across the skin in shaving action.

2. The razor of claim 1 wherein said skin-engaging surface of said protective sheet structure has low friction characteristics.

3. The razor of claim 1 wherein said protective sheet structure includes shave-facilitating material at said skin-engaging surface.

4. The razor of claim 1 wherein said protective sheet structure includes a film member of polymeric material selected from the group consisting of cellulose acetate, cellophane, vinyl, polytetrafluoroethylene and polyester.

5. The razor of claim 1 wherein said protective sheet structure includes a film member of a high tear resistant polymer.

6. The razor of claim 1 wherein the thickness of said protective sheet structure is less than the thickness of said foil member.

7. The razor of claim 1 wherein the thickness of said protective sheet structure is less than about one millimeter.

8. The razor of claim 1 wherein said protective sheet structure includes an adhesive for securing said foil to said body member.

9. The razor of claim 8 wherein said adhesive is a blend of elastomers with tackifying resins, plasticizer and the like, or an inherently pressure sensitive polymer.

10. The razor of claim 8 wherein said adhesive is a water resistant, pressure sensitive contact adhesive.

11. The razor of claim 1 wherein said support surface is of convex configuration, and said metal foil blade member is flexed into bowed configuration that conforms to said convex configuration of said support surface.

12. The razor of claim 11 wherein said support surface includes recess structure for receiving the outer periphery of said foil member.

13. The razor of claim 12 wherein the depth of said recess and the thickness of said foil member are substantially the same.

14. The razor of claim 13 wherein said depth of said recess and said thickness of said foil member are each about 0.1 millimeter.

15. The razor of claim 1 wherein said metal foil member has at least ten shaving edge defining apertures.

16. The razor of claim 15 wherein said apertures are of circular configuration.

17. The razor of claim 15 wherein said support surface is of convex configuration, said support surface includes recess structure for receiving the outer periphery of said foil member, the depth of said recess and the thickness of said foil member are substantially the same, and said metal foil blade member is flexed by said protective sheet structure into bowed configuration that conforms to said convex configuration of said support surface.

18. The razor of claim 17 wherein said protective sheet structure includes a film member of polymeric material, the thickness of said protective sheet structure is less than the thickness of said foil member, and said protective sheet structure includes an adhesive for securing said foil member to said body member.

19. The razor of claim 18 wherein said protective sheet structure includes shave-facilitating material on said film member.

20. The razor of claim 18 wherein said film member is selected from the group consisting of cellulose acetate, cellophane, vinyl, polytetrafluoroethylene and polyester; and said adhesive is a water-resistant, pressure-sensitive contact adhesive.

* * * * *